US007568706B2

(12) United States Patent
Ng et al.

(10) Patent No.: US 7,568,706 B2
(45) Date of Patent: Aug. 4, 2009

(54) MECHANISM FOR CONVERSION OF VERTICAL FORCE TO A TORQUE AND MOTIVE DEVICE AND METHOD EMPLOYING SAME

(76) Inventors: Kenneth Yat Chung Ng, 1111 Corporate Center Dr., No. 304 A, Monterey Park, CA (US) 91754; Edmund Yat Kwong Ng, 1111 Corporate Center Dr., No. 304 A, Monterey Park, CA (US) 91754

( * ) Notice: Subject to any disclaimer, the term of this patent is extended or adjusted under 35 U.S.C. 154(b) by 185 days.

(21) Appl. No.: 11/520,917

(22) Filed: Sep. 13, 2006

(65) Prior Publication Data

US 2008/0061521 A1 Mar. 13, 2008

(51) Int. Cl.
*B62M 1/04* (2006.01)

(52) U.S. Cl. ..... 280/11.115; 280/221; 280/87.042; 280/841; 280/7.13; 280/7.12

(58) Field of Classification Search ..... 280/221, 280/11.115, 87.042, 841, 7.13, 7.12
See application file for complete search history.

(56) References Cited

U.S. PATENT DOCUMENTS

| | | | | |
|---|---|---|---|---|
| 674,096 | A | 5/1901 | Pease | |
| 732,120 | A | 6/1903 | Schmidt | |
| 942,333 | A | 12/1909 | Lennox | |
| 999,660 | A | 8/1911 | Koppel | |
| 1,208,173 | A | 12/1916 | Lenhardt | |
| 1,338,813 | A | 5/1920 | Chiarelli | |
| 1,437,314 | A | 11/1922 | Jorgensen | |
| 1,784,761 | A | 12/1930 | Smith | |
| 1,924,948 | A * | 8/1933 | Lieberenz | 280/11.115 |
| 2,585,582 | A * | 2/1952 | Pierce | 313/338 |
| 4,602,801 | A | 7/1986 | Vincent | |
| 4,691,931 | A * | 9/1987 | Vincent | 280/11.115 |
| 4,706,974 | A | 11/1987 | Vincent | |
| 5,056,802 | A | 10/1991 | Piotrowski | |
| 5,224,719 | A * | 7/1993 | Goodspeed | 280/11.115 |
| 5,310,202 | A * | 5/1994 | Goodspeed | 280/221 |
| 5,492,345 | A | 2/1996 | Kruczek | |
| 6,237,923 | B1 * | 5/2001 | Fowle | 280/11.115 |
| 6,336,643 | B1 * | 1/2002 | Wu | 280/11.115 |
| 6,585,273 | B2 * | 7/2003 | Chiu | 280/11.223 |
| 6,588,784 | B1 | 7/2003 | Chen | |
| 6,626,442 | B2 | 9/2003 | Pahis | |
| 7,073,805 | B2 * | 7/2006 | Yan | 280/221 |

* cited by examiner

*Primary Examiner*—Christopher P Ellis
*Assistant Examiner*—Cynthia F Collado
(74) *Attorney, Agent, or Firm*—Foley & Lardner LLP

(57) ABSTRACT

A mechanism for the conversion of a force applied in one direction to a rotational force. The rotational force may provide for movement in a second direction. The system utilizes mechanical parts and the movement of these parts to convert the directional force to a rotational force. The system can help to utilize unused forces to the benefit of a user reducing workload and/or increasing speed.

23 Claims, 13 Drawing Sheets

MECHANISM FOR CONVERSION OF VERTICAL FORCE TO A TORQUE AND MOTIVE DEVICE AND METHOD EMPLOYING SAME

BACKGROUND OF THE INVENTION

1. Field of the Invention

Embodiments of the present invention relate to devices and methods aiding in movement of people and objects in general including but not limited to a dolly, a cart, a fork lift, a hand truck, a roller skate and the like.

2. Related Art

Various devices for aiding in movement of people and objects along a surface have been proposed, in which rotatable wheels are attached to a structural body. When a force is applied in the desired direction of movement, the wheels rotate along the surface and decrease friction between the structural body and the surface.

Various different mechanisms and methods have been used for applying such a force, including a motor that connects, through a transmission or other linkage to one or more wheels, to impart a rotational force to the connected wheels. Other mechanisms have employed a rotary pedal configuration in which foot pedals are attached to a rotary sprocket and a chain or belt connects the sprocket to a wheel gear.

Wheel motion on such apparatuses is usually limited to rotational motion about an axis of rotation. However, wheels on a roller skate or in-line skate are moved up and down (relative to the riding surface), as the rider's legs are lifted and set down, to impart a motive force in a generally horizontal direction of travel. As a result of the up and down motion of the wheels during a skating motion, much force is exerted in a perpendicular direction to the movement of the apparatus, resulting in a considerable amount of wasted energy.

Previous inventions have attempted to remedy the problem, but either required complicated designs or required alteration of the conventional style of use of the device. Examples of previous designs are described in U.S. Pat. Nos. 1,208,173; 732,120; 1,924,948; 1,437,314; and, 1,784,761, each of which are incorporated herein by reference, in its entirety.

SUMMARY OF THE DISCLOSURE

Embodiments of the current invention may be configured to address one or more of the above-mentioned problems, including providing a system and method for converting a perpendicular force to a rotational force and utilizing the rotational force to propel the system in the desired direction. Further embodiments of the invention relate to a method of manufacturing such a system.

More particularly, a system according to a first preferred embodiment converts a force applied to the system in one direction to a rotational force to drive the system in a second direction. The system in this embodiment comprises a pressure part, a motive force transfer mechanism engaged with the pressure part and moveable between at least two states, a spin restricting mechanism with at least two parts that move with respect to each other, and a bias member that provides a bias force. The motive force transfer mechanism has a resting state, wherein no external forces are acting on the system, and an active state, wherein an external force is acting on the pressure part. The motive transfer mechanism is coupled to the system along a single axis allowing it to pivot freely along that axis with respect to the pressure part and to compress in a scissor-like fashion. The motive transfer mechanism engages with a first part of the spin restricting mechanism when transitioning between the resting state and the active state. The bias member causes the motive transfer mechanism to transition back to the resting state when no external force is applied to the system.

The spin restricting mechanism has a first part and a second part that rotate independently along a shared axis in one direction, and are coupled and rotate together in the opposite direction. As a result, the system may provide a rotational force in two directions to the first part, but will only transfer a rotational force in one direction to the second part. Accordingly, the system may be driven in one direction, such as a forward direction.

A system in a second preferred embodiment comprises a system of the first embodiment, but with a plurality of wheels and each wheel is attached to a second part of a spin restricting mechanism. Each spin restricting mechanism is engaged to the motive force transfer mechanism. This provides an advantageous results that the system may move along a surface in a given direction from a force provided perpendicular to the surface.

A system in a third preferred embodiment comprises a system of the first embodiment, but with a plurality of wheels and at least one wheel attached to a second part of a spin restricting mechanism. This provides an advantageous result that the system may move along a surface in a given direction from a force provided perpendicular to the surface.

A system in a fourth preferred embodiment comprises a system of the first embodiment, but wherein the first part and second part of the spin rotation mechanism have locking elements that lock into each other when rotating in one direction, but slide against each other freely when rotating in the opposite direction. These locking elements may comprise a first plate with wedges in the shape of ramps, and a second plate with slots or holes that are shaped to receive the wedges.

A system in a fifth preferred embodiment comprises a system of the third embodiment, but wherein the pressure part comprises a shoe attached to the motive transfer function.

A system in a sixth preferred embodiment comprises a system of the third embodiment, but wherein the pressure part comprises a platform on which a user may step.

A system in a seventh preferred embodiment comprises a system of the sixth embodiment, but with a member (for example straps) to secure the user's foot, shoe, or the like to the system.

DETAILED DESCRIPTION OF PREFERRED EMBODIMENTS

Embodiments of the present invention relate to motive systems and methods aiding in movement of people and objects in general including but not limited to a skate, a dolly, a cart, a fork lift, a hand truck, and the like, and components thereof. In addition, embodiments of the invention relate to motive systems and methods for converting a force (such as, but not limited to, a perpendicular or generally perpendicular force) to a rotational force. Motive systems and methods according to embodiments of the present invention include (1) a scissoring motive transfer mechanism and a drive train linkage that converts force applied in one direction (such as a vertical, downward force applied by a user making a stepping motion) into a rotational force for driving one or more rotary wheels; and (2) a spin restricting mechanism for restricting the rotary wheel(s) to only one direction of rotation.

Figure 1:
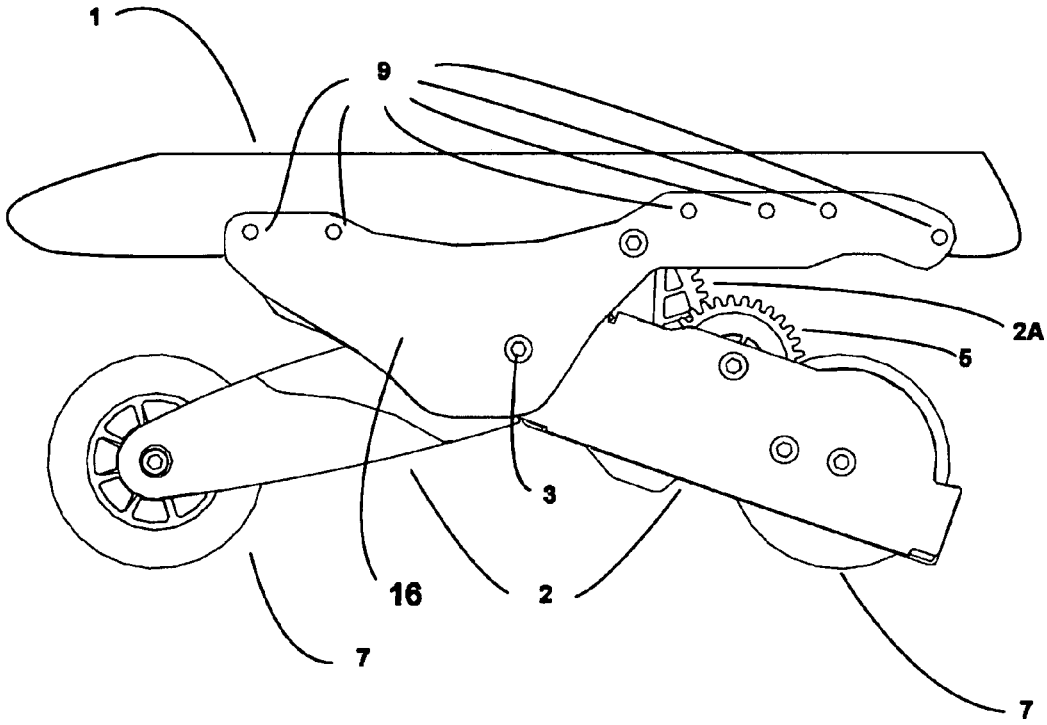
FIG. 1 is an external side view of a motive system according to an embodiment of the invention in its original uncompressed form.
Figure 2:
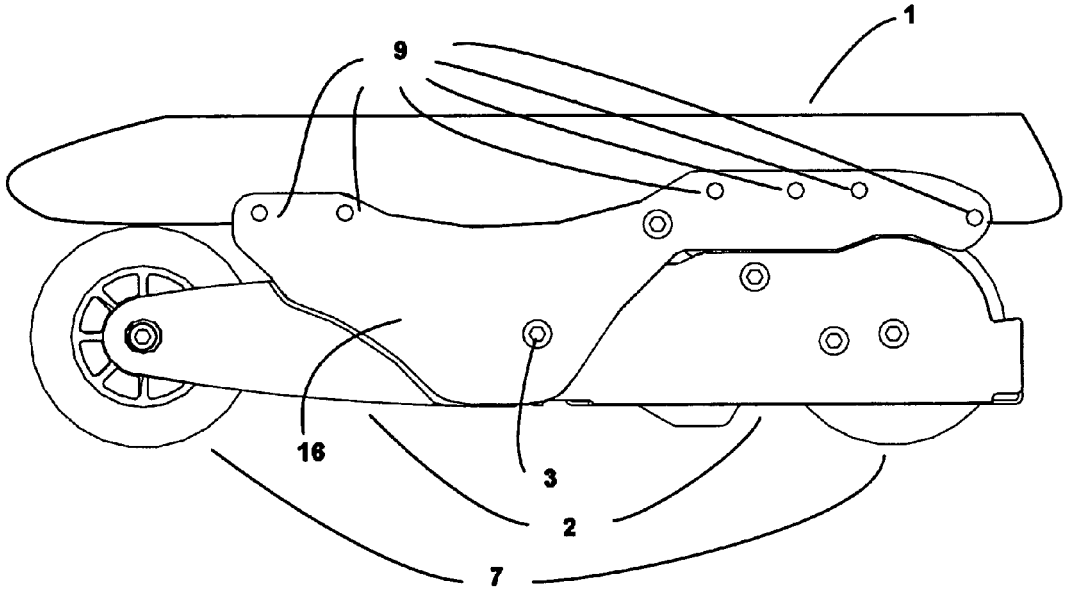
FIG. 2 is an external side view of the motive system of FIG. 1 in its compressed form.
Figure 12:
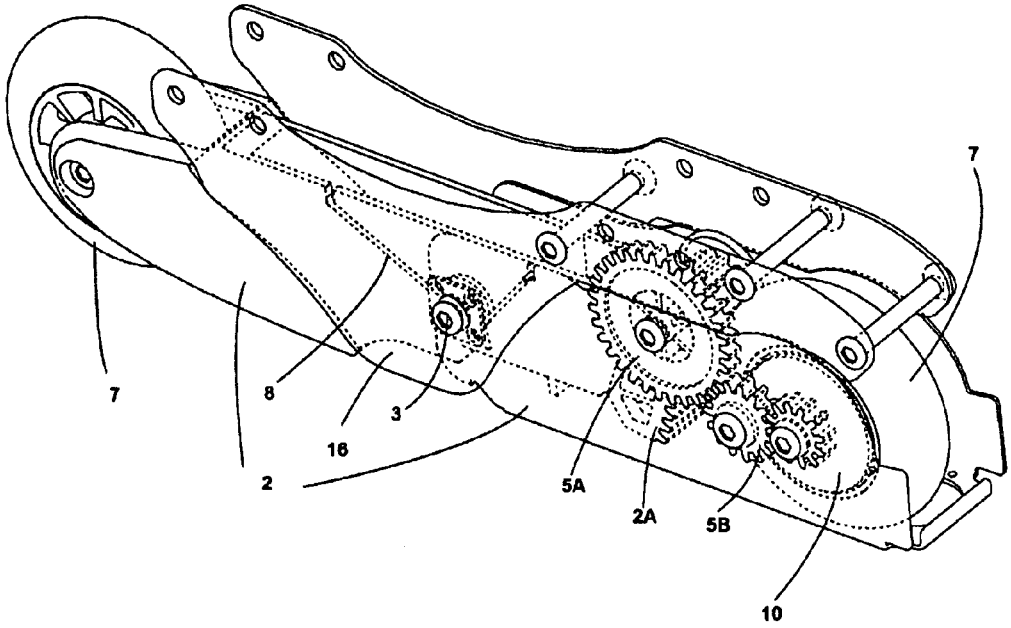
FIG. 12 is a perspective view of the motive system of FIGS. 1-3, in its compressed form.

A motive system according to an embodiment of the present invention is shown in FIGS. 1-3 and 12, in various positional states. FIG. 1 is an external side view of system structure in an uncompressed or resting state. FIG. 2 is an external side view of the system of FIG. 1, but in a compressed or active state. The exterior of the system, as shown in FIGS. 1 and 2, is provided with a pressure part 1, a scissoring motive transfer mechanism 2, a drive train 5, wheels 7, and a chassis 16. FIG. 12 is a perspective top-side view of the system structure in the compressed or active state, with the pressure part 1 omitted to provide a clearer view of various components within the motive system.

Figure 3:
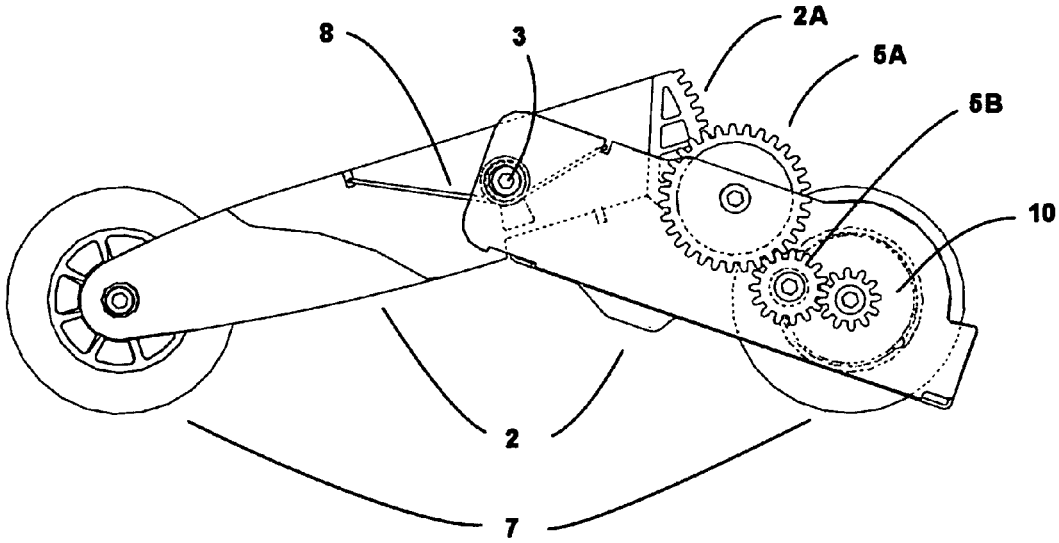
FIG. 3 is an internal side view of the motive system of FIG. 1 with the housing removed.

FIG. 3 is an internal side view of the embodiment of the system of FIG. 1. The interior of the system, as shown in FIG. 3, is provided with a bias member 8, a rod or bar 3 supported for pivotal motion about its longitudinal axis, a drive train 5, and a spin restricting mechanism (not shown in FIG. 3 but illustrated in FIGS. 6-8).

Figure 13:
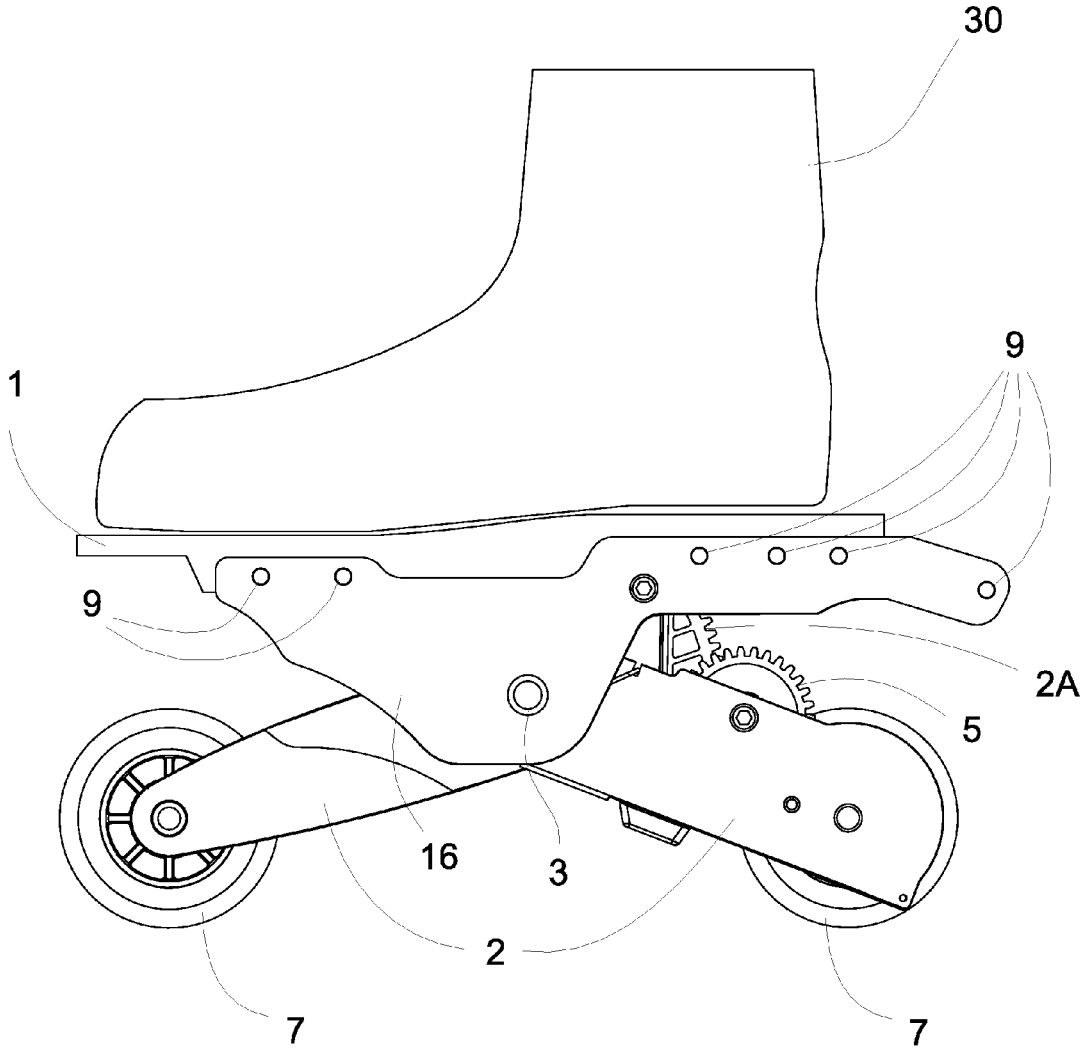
FIG. 13 is an external side view of a motive system according to an embodiment of the invention in its original uncompressed form.

The system of FIGS. 1-3 and 12 may be employed, for example, in a skate structure for allowing a user to skate along a surface. A skate structure according to embodiments of the present invention may be secured directly to each foot of a user. Alternatively, the skate structure may be incorporated with a skate shoe, in a manner similar to a traditional roller skate (see for example, shoe 30 of FIG. 13). In other embodiments, the skate structure may be employed in another form of a motive system, including but not limited to a dolly, a cart, a fork lift, a hand truck, and the like.

According to an example embodiment shown in FIG. 1, the pressure part 1 comprises a stepping plate that may be part of the chassis 16. The stepping plate may provide a generally planar surface on which the sole of a users shoe or foot may impart a generally downward-directed manual force, while making a stepping motion. In other embodiments, the pressure part 1 may comprise the sole of a shoe structure for receiving a user's foot. However, other embodiments of the pressure part may include, but are not limited to, a platform, foot rail or a hand rail, on which manual force is applied by a user's foot or hand. In one embodiment according to FIG. 1 the chassis 16 may be directly attached to a shoe structure by a series of fastening elements (for example screws) that extend through mounting holes 9 into, for example, the sole of a shoe structure. In other embodiments, other suitable structure for securing the chassis 16 to a user's foot or to a shoe structure may be employed, including, but not limited to straps, adhesive material, or the like. The chassis 16 may be connected to the motive transfer mechanism 2 at a single axis, by a pivoting rod or bar 3. The pivoting rod or bar 3 can be a screw, a bolt, a rod, or a ball-bearing device, and the like. In this embodiment, the pivoting rod or bar 3 is not stationary relative to the chassis 16 or motive transfer mechanism 2, and may rotate freely relative to either structure. In alternative embodiments, the rod or bar 3 may be non-rotating and provide a fixed axle about which the chassis 16 and motive transfer mechanism 2 may pivot in a rotary manner.

In an embodiment according to FIG. 1 the motive force transfer mechanism 2 has a scissor-like shape made of two arms connected at a pivot axis by the pivotal rod or bar 3, as shown in FIG. 3. The arms may be made of any suitably rigid material, including, but not limited to metal, plastic, composite material or the like. The arms are pivotal about the pivot axis, between a first final state (which may be a resting state or uncompressed state) as shown in FIG. 1, and a second final state (which may be a compressed state) as shown in FIG. 2. The bias member 8 may comprise a coil spring that imparts a spring force on the two metal arms. In the illustrated embodiment, the bias member comprises a coil spring having a first spring arm connected in a fixed relation with one of the two scissor arms and a second spring arm connected in a fixed relation to the other of the two scissor arms and a coil arranged around the pivot axis of the scissor arms, for biasing the scissor arms toward the first final state (as shown in FIG. 1). However, in other embodiments, the bias member 8 may comprise a leaf spring or pneumatics. The arms may rotate with respect to each other and with respect to the pressure part 1 around the axis of the pivoting bar 3. This may provide the advantageous result that pressure may be applied to the pressure part 1 in whatever foot angle position (foot angle, relative to the direction of a downward stepping motion) is most natural or comfortable for each user while still engaging the motive transfer mechanism 2.

When no external force is applied to the motive force transfer mechanism 2, the bias member 8 applies a force to the metal arms so they are in an uncompressed position as shown in FIG. 1.

When a sufficient external force to overcome the force of the bias member 8 (such as, but not limited to, a force from a user's foot as the user makes a downward stepping motion) is applied to the pressure part 1 while the motive transfer mechanism 2 is supported on a surface of travel, the bias member 8 compresses and the arms rotate into a compressed state as shown in FIG. 2.

Figure 4:
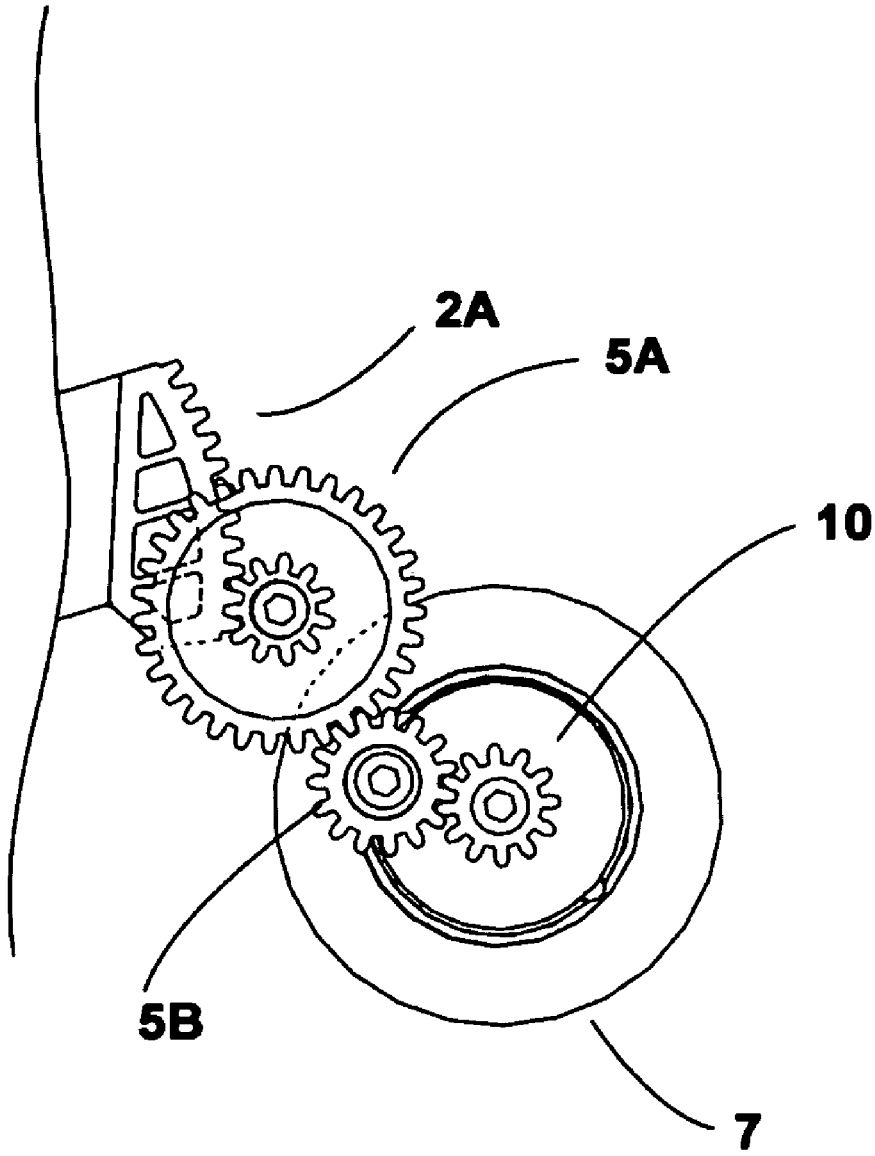
FIG. 4 is a close-up view of a drive train mechanism according to an embodiment of the invention.

According to an embodiment of the system of FIGS. 1-3, a series of teeth 2A are provided along the end of at least one of the metal arms, for engaging a first gear 5A of the drive train 5. The series of teeth 2A are shaped to engage with a first, smaller ring of teeth on the gear 5A as shown in FIG. 4. Gear 5A also has a second, larger ring that rotates on the same axis and together with the smaller ring of teeth.

According to the embodiment of a drive train 5 in FIG. 4, a larger ring of gear 5A may have teeth and may be engaged with teeth of a second gear 5B of the drive train 5, which in turn may be engaged with teeth of a third gear 10, which according to the embodiment of FIG. 4 may be attached to the spin restricting mechanism for rotation with a portion of the spin restricting mechanism.

Figure 5:
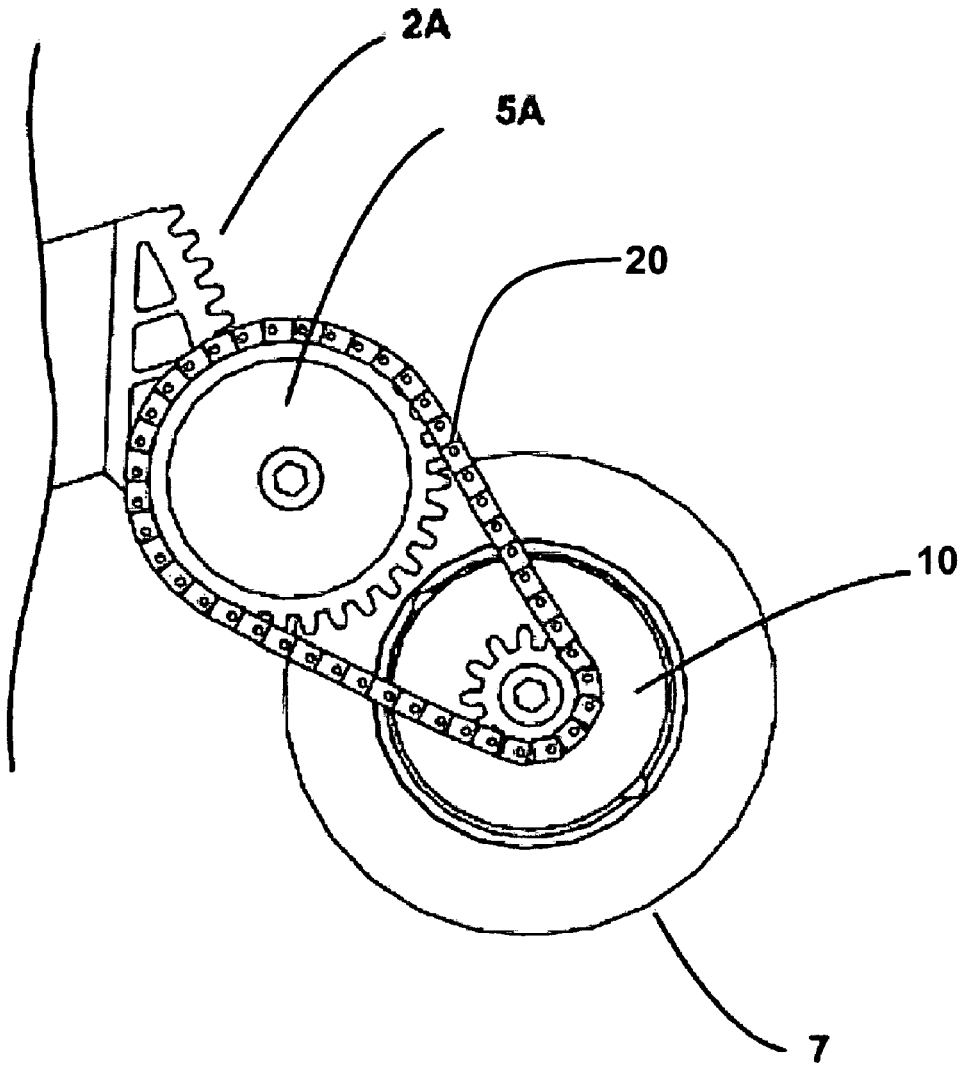
FIG. 5 is a close-up view of a drive train mechanism according to another embodiment of the invention.
Figure 9:
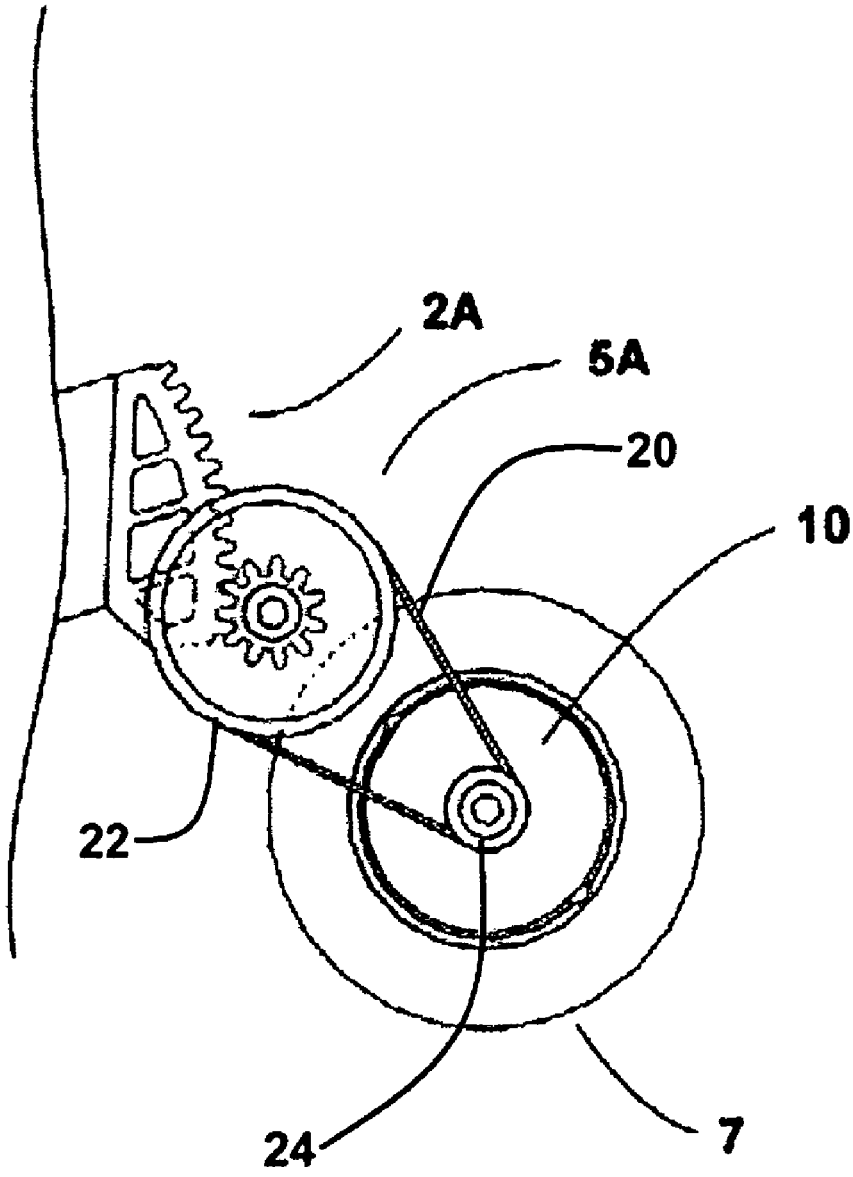
FIG. 9 is a close-up view of a drive train mechanism according to a further embodiment of the invention.

According to another embodiment shown in FIG. 5, the larger ring on gear 5A may have teeth and may be connected to a gear 10 through the use of a chain 20. In yet a further embodiment as shown in FIG. 9, each of the larger ring on the gear 5A and the gear 10 may comprise a pulley 22 and 24 and the two pulleys may be coupled by a belt 20 instead of the chain 20 shown in FIG. 5. Accordingly, a chain or belt may transfer rotational motion between the gear 5A and the gear 10.

The drive train 5 provides an operable link between the scissoring arm structure and the gear 10, to provide a rotational drive force to rotate gear 10. More specifically, the drive train transfers a rotational force for rotating the gear 10 in a first direction around the axis of gear 10, as the scissoring arm structure is moved from the uncompressed or rest state (FIG. 1) to the compressed or active state (FIG. 2). The drive train transfers a rotational force for rotating the gear 10 in a second direction around the axis of the gear 10 (opposite to the first direction), as the scissoring arm structure is returned from the compressed or active state (FIG. 2) to the uncompressed or rest state (FIG. 1).

However, the spin restricting mechanism is operatively coupled to the gear 10, to transfer the rotational motion of the gear 10 in the first direction to a wheel, but not transfer rotational motion of the gear 10 in the second direction to the wheel. Accordingly, a rotational motive force may be applied to the wheel in a desired direction of motion.

Figure 6:
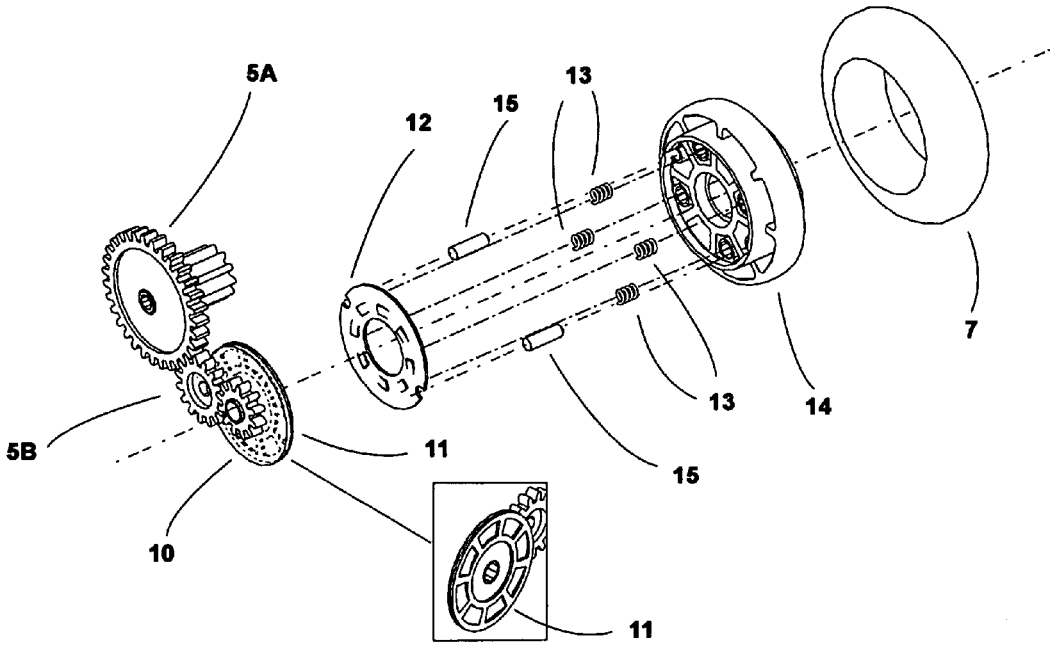
FIG. 6. is an exploded view of an embodiment of a spin restricting mechanism.

FIG. 6 shows an exploded view of an embodiment of a spin restricting mechanism. According to an example of this embodiment one part of a spin restricting mechanism comprises a circular plate 12 coupled in a fixed relation to a wheel hub 14. The wheel hub 14 is supported for rotation about an axis of an axle. The wheel hub axle is connected to one end portion of one of the scissor arms. A second part of a spin restricting mechanism comprises a slotted plate 11 coupled in a fixed relation to the gear 10, to rotate with the gear 10. A wheel 7 may be coupled in a fixed relation to the wheel hub 14, to rotate with the wheel hub. The plates 11 and 12 and the wheel hub 14, each may be formed of any suitably rigid material, including, but not limited to metal, plastic, composite material or the like.

The wheel hub 14 may be provided with a plurality of spring receptacles and pin receptacles arranged in a spaced relation, around the rotational axis of the wheel hub 14. The spring receptacles may comprise channels or other structures that are capable of receiving and/or retaining springs. The pin receptacles may comprise channels or other structures that are capable of receiving and/or retaining pins.

A plurality of springs 13, such as coil springs having longitudinal axes, may be received, at least partially within the spring receptacles, such that an end portion of the spring is extends outward from the hub 14. A plurality of pins 15 having longitudinal axes may be received partially within the pin receptacles, such that an end portion of each pin extends outward from the hub 14, in a direction generally parallel to the rotational axis of the hub. The circular plate 12 may be coupled in a fixed relation to the wheel hub 14 by arranging the outward extended ends of the pins 15 to extend through holes in the circular plate 12. Accordingly the circular plate 12 and wheel hub 14 rotate together along a common axis. The outward extended ends of the springs 13 are positioned to abut or otherwise impart a spring force on the circular plate 12. The circular plate 12 may have some freedom of movement in the axial direction (of the axis of rotation), which causes springs 13 to compress and decompress accordingly. The slotted plate 11, which may also have a circular shape, is arranged adjacent the circular plate 12, opposite to the spring-side of the plate 12, such that the springs 13 impart a force on the plate 12 to push the plate 12 against the slotted plate 11.

Figure 7:
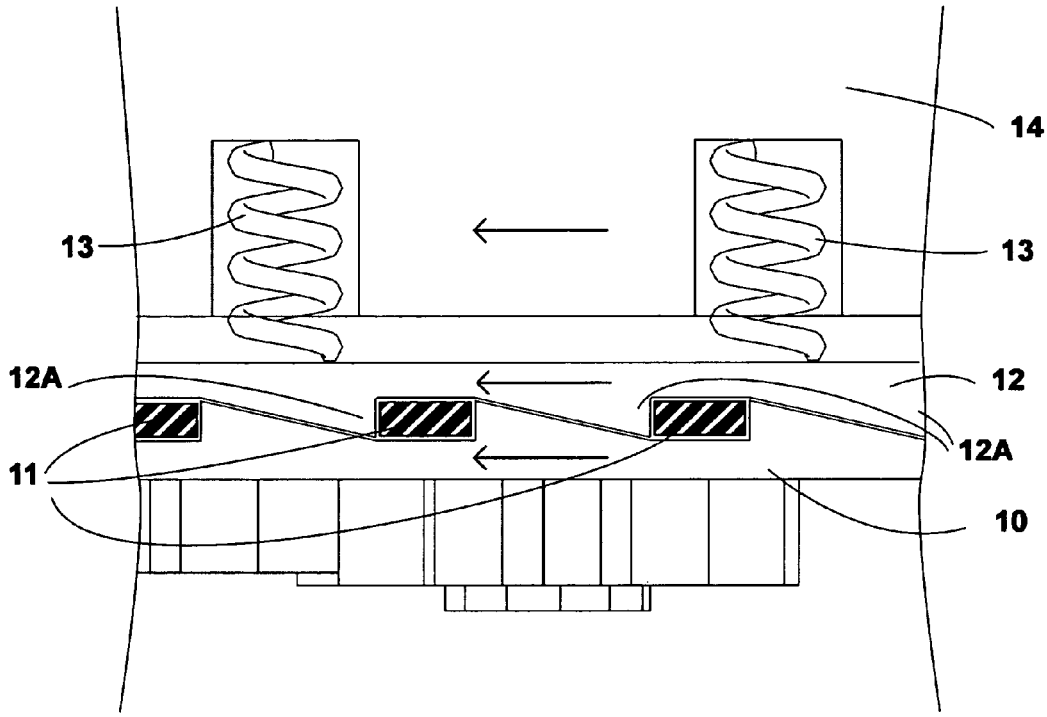
FIG. 7. is a top internal view of an embodiment of a spin restricting mechanism where wedges on a circular plate are locked into a spinning slotted plate.

According to an embodiment of the spin restricting mechanism as shown in FIG. 6, the circular plate 12 may have wedge-shaped portions on the surface facing away from the wheel hub 14. Each wedge-shaped portion may be configured to form a ramp-like shape as shown in FIG. 7. Each wedge-shaped portion may have a ramp side 12B that starts flush with a plate surface of the plate 12, and rises at an angle less than 90 degrees. The wedge then forms a relatively sharp drop to the plate surface, forming an edge 12A that is approximately perpendicular (or greater than 90 degrees) to the plate surface. The wedges may all be aligned so the ramps face the same rotational direction. The slots on the slotted plate 11 may be about the same size as or larger than the wedges on the circular plate 12.

FIG. 7 shows an internal top view of an embodiment of a spin restricting mechanism according to FIG. 6. In this embodiment, when the slotted plate 11 is rotated in the direction so that the edge of the slots slide down the ramp side 12B of one wedge and hit the edge 12A of another wedge, the circular plate 12 locks into the slotted plate 11 and may be held in place by the force from the springs 13. When locked, rotation of the slotted plate 11 in a first direction around the axis of the hub 14 transfers, through the edges 12A of the wedges, to plate 12 to cause rotation of the plate 12, wheel hub 14 and wheel 7.

Figure 8:
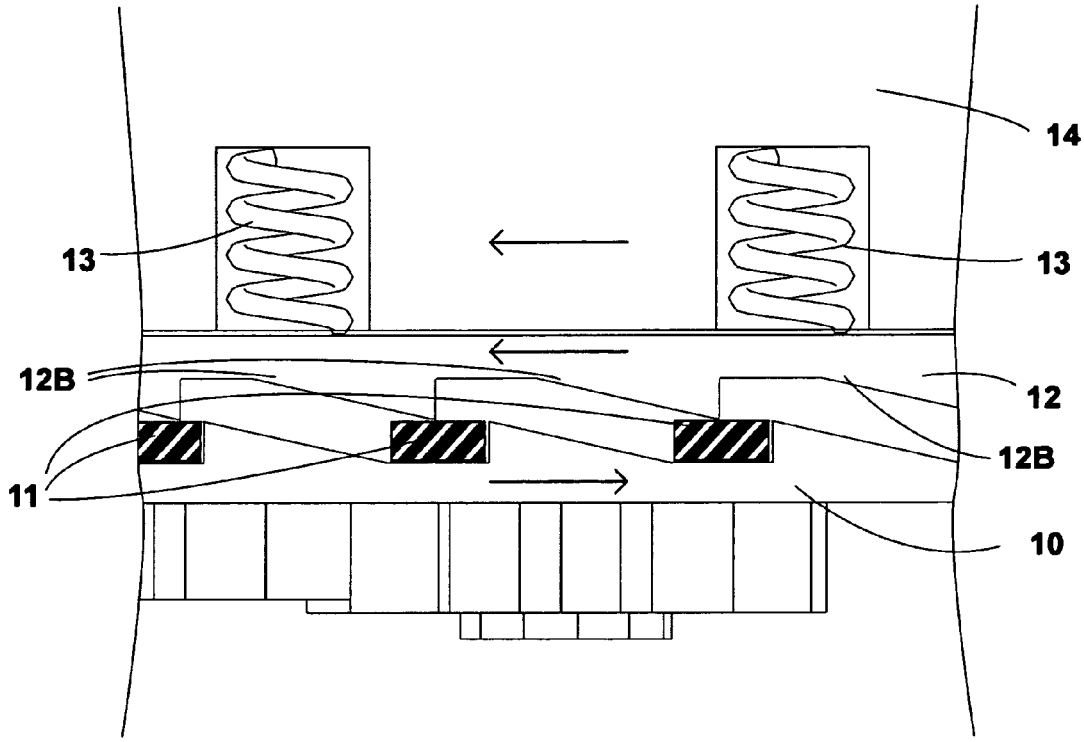
FIG. 8. is a top internal view of an embodiment of a spin restricting mechanism where wedges on a circular plate are sliding along a spinning slotted plate.

FIG. 8 shows an internal top view of an embodiment of a spin restricting mechanism according to FIG. 6. In this embodiment, when the slotted plate 11 is rotated in a second direction (opposite to the first direction of rotation) so that the edge of the slots slide up the ramp side 12B of each wedge and then falls back to the surface, the circular plate 12 is not locked for rotation with the slotted plate 11 and the slotted plate 11 may rotate in a second direction (opposite to the first direction) independently of the circular plate 12. The springs 13 compress and decompress as the slotted plate 11 moves up and down the ramps.

Embodiments of FIG. 6 of the spin restricting mechanism 6 provide an advantageous result that the wheel only spins in one direction and only receives a force from the slotted plate 11 in one rotational direction. Accordingly, the skate will only be propelled forward when the motive force transfer mechanism 2 is moved from an uncompressed or rest state (FIG. 1) to a compressed or active state (FIG. 2) and may continue spinning in that direction when the motive force transfer mechanism 2 returns from the active state (FIG. 2) to the rest state (FIG. 1) and decompresses.

An embodiment of the invention according to FIGS. 1-8 may function so that when a user steps down on the pressure plate 1, the wheels 7 come in contact with a surface of travel, such as the ground, the force of the user's body weight along with the counteracting force from the surface of travel cause the motive transfer mechanism 2 to move from an uncompressed or rest state (FIG. 1) to a compressed or active state (FIG. 2). As the metal arm with the teeth 2A moves during the compression, the movement causes the gear 5A engaged with the teeth 2A to rotate. The rotation of the gear 5A is transferred to gear 10, for example, through a further gear 5B chain, belt or the like.

The slotted plate 11 is coupled to rotate with gear 10 and the edge of the slots rotates along the circular plate 12 until they engage an edge 1 2A, causing the circular plate to rotate with the slotted plate. The wheel hub 14 and wheel 7 are coupled, in a fixed relation to the circular plate 12, through the pins 15 and, thus, rotate with the rotation of the circular plate 12. Accordingly, the energy of the vertical motion of the pressure plate 1 and the compression of the scissor arm structure is transferred to a rotational motion of the wheel 7, for propelling the user forward.

When the user steps back up, the compression force is released and the wheels may be lifted off of the ground. As a result, the bias member 8 forces the arms back into the decompressed or rest state (FIG. 1). The gear 10 is rotated again by the movement of toothed arm, but in the opposite direction relative to the direction of rotation during a compression step. The slotted plate 11 is coupled in a fixed relation to the gear 10 and, thus, rotates with gear 10. As the slotted plate rotates, the edges of each slot rotate along a circular plate 12 moving up and down the ramp portions 12B so as to allow the wheels 7 and circular plate 12 to continue rotating in the forward direction. To allow the ramp portions to readily slide along the plate 12, the circular plate 12 may move along the axis of rotation from a force from the slotted plate 11, against or with the spring force of springs 13.

Accordingly, in this embodiment, the user may repeat the stepping motions to continue propelling the skate and the user forward.

Figure 10:
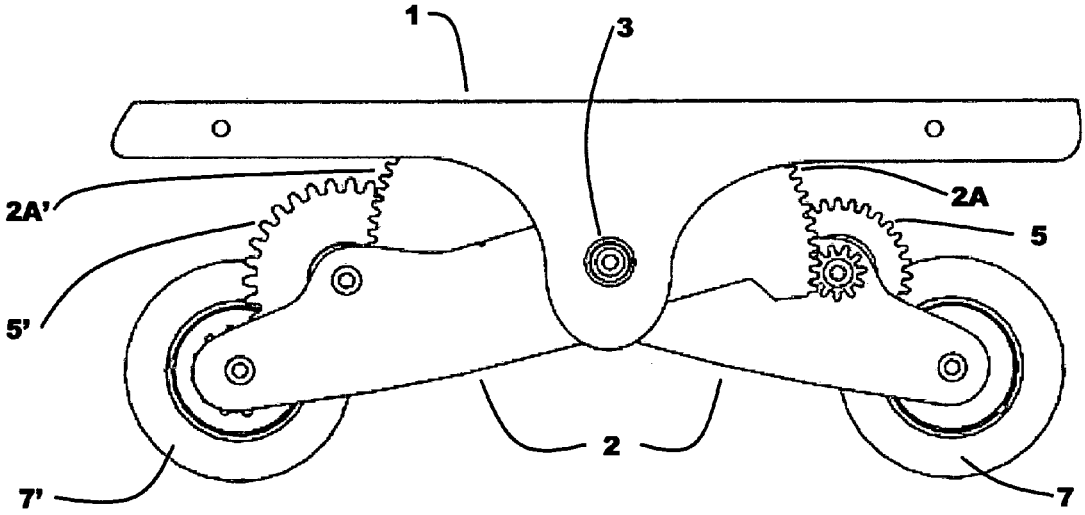
FIG. 10 is an external side view of a motive system according to a further embodiment of the invention in its original uncompressed form.
Figure 11:
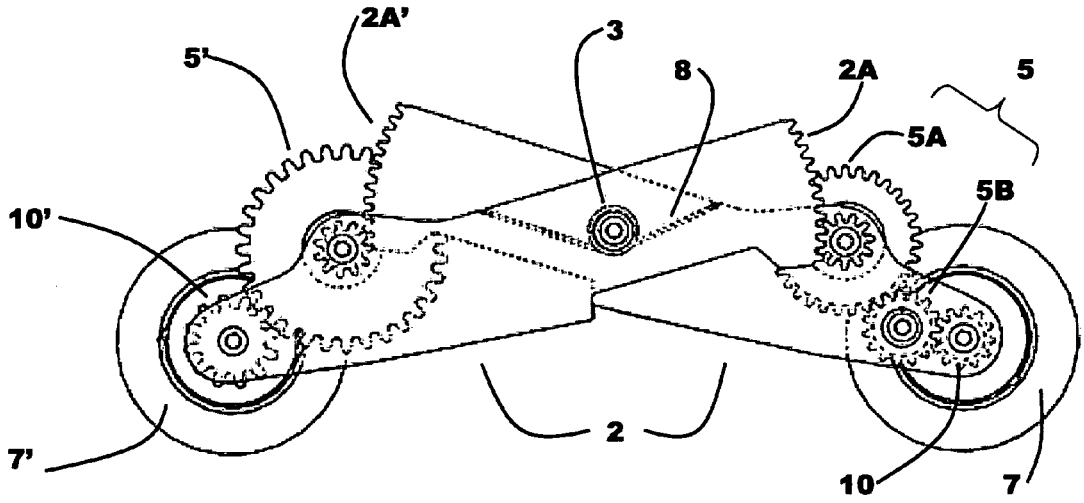
FIG. 11 is an internal side view of the motive system of FIG. 10 with the housing removed.

FIG. 10 & 11 illustrate a further embodiment of a motive system that engages more than one wheel. FIG. 10 is an external side view of the motive system in its original uncompressed form, and FIG. 11 is an internal side view of the motive system of FIG. 10. Similar to the motive system of FIG. 1, the motive system of FIGS. 10-11 comprises a pressure part 1, a scissoring motive transfer mechanism 2, a pivotal rod or bar 3, wheels 7 and 7', and a bias member 8. As illustrated in FIG. 11, each of the end of the two arms of the scissoring motive transfer mechanism 2 comprises a series of teeth 2A and 2A'. Each series of teeth 2A and 2A' engages with one of drive mechanisms 5 and 5', respectively. In turn, each of the drive mechanisms 5 and 5' engages with one of gear 10 (connected to wheel 7) or gear 10' (connected to wheel 7'). Each of the wheels 7 and 7' also comprises a spin restricting mechanism (not shown in FIGS. 10-11, but illustrated in FIG. 6.) Therefore, this provides the advantageous result that as a downwards force is applied to the pressure part 1, the downwards force is transferred and distributed to rotational motions of both wheels 7 and 7', for propelling the user forward.

Further, the gears of the two drive mechanisms 5 and 5' may comprise a different number of gears or different gear ratios. For example, as illustrated in FIG. 11, the drive mechanism 5 comprises a set of two gears 5A and 5B, whereas the drive mechanism 5' comprises only one gear 5'. Therefore, by varying the number of gears or gear ratios between the two drive mechanisms 5 and 5', the proportional fraction of force transferred to the two wheels 7 and 7' can be adjusted.

An explanation of the present invention was given above of the present invention based on several preferred embodiments. However, the present invention is in no way limited to the preferred embodiments described above. Various modifications and changes that do not deviate from and are within the scope of the essentials of the present invention can be easily surmised.

What is claimed is:

1. A system for converting a force applied in one direction to a rotational force comprising:

a pressure part for receiving an operative force in a first direction;

a motive force transfer mechanism comprising two arms joined at a pivot point and moveable relative to each other in a scissors fashion between at least two states including an uncompressed state and a compressed state, the motive force transfer mechanism being operatively coupled to the pressure part, for moving the two arms from the uncompressed state to the compressed state upon a suitable force in the first direction being received by the pressure part;

a bias member that provides a bias force on at least one of the two arms, for biasing the two arms toward the uncompressed state, a spin restricting mechanism with at least two parts, a first part and a second part that are arranged to be coupled and rotate together around a shared axis in a first rotary direction, but may rotate independently around the shared axis in a second rotary direction opposite to the first rotary direction; and a linkage structure for operatively linking at least one of the two arms to the first part of the spin restricting mechanism, to communicate movement of at least one of the arms from the uncompressed state to the compressed state into rotational motion of the first part of the spin restricting mechanism in the first rotary direction.

2. A system according to claim 1, wherein the linkage structure also communicates movement of the at least one of the arms from the compressed state to the uncompressed state into rotational motion of the first part of the spin restricting mechanism in a second rotary direction.

3. A system according to claim 2, further comprising a wheel coupled to rotate together with the second part of the spin restricting mechanism.

4. A system according to claim 1, further comprising a wheel coupled to rotate together with the second part of the spin restricting mechanism.

5. A system according to claim 1, wherein:

the at least one of the two arms comprises a series of teeth arranged to move in a first direction as the arms move from the uncompressed state to the compressed state, and in a second direction as the arms move from the compressed state to the uncompressed state;

the linkage structure comprises a first gear for engaging the teeth and rotating in a first gear rotation direction as the teeth on the at least one arm move in the first direction, and rotating in a second gear rotation direction opposite to the first gear rotation direction as the teeth move in the second direction;

the system further comprising a second gear coupled for rotation with the first part of the spin restricting element, wherein the second gear is operatively coupled to the first gear, for rotation dependent on the rotation of the first gear.

6. A system according to claim 5, wherein the second gear is operatively coupled to the first gear through a chain, or any number of intermediate gears, or a belt.

7. A system for converting a force applied in one direction to a rotational force comprising:

a pressure part for receiving an operative force in a first direction;

a motive force transfer mechanism comprising two arms joined at a pivot point and moveable relative to each other in a scissors fashion between at least two states including an uncompressed state and a compressed state, the motive force transfer mechanism being operatively coupled to the pressure part, for moving the two arms from the uncompressed state to the compressed state upon a suitable force in the first direction being received by the pressure part;

a bias member that provides a bias force on at least one of the two arms, for biasing the two arms toward the uncompressed state, a spin restricting mechanism with at least two parts, a first part and a second part that are arranged to be coupled and rotate together around a shared axis in a first rotary direction, but may rotate independently around the shared axis in a second rotary direction opposite to the first rotary direction; and a linkage structure for operatively linking at least one of the two arms to the first part of the spin restricting mechanism, to communicate movement of at least one of the arms from the uncompressed state to the compressed state into rotational motion of the first part of the spin restricting mechanism in the first rotary direction, wherein:

the first part of the spin restricting mechanism comprises a first plate supported for rotation about the shared axis and having a first plate surface;

the second part of the spin restricting mechanism comprises a second plate supported for rotation about the shared axis and having a second plate surface arranged to face the first plate surface of the first plate;

one of the first and the second plate surfaces having a plurality of wedge-shaped portions extending outward toward the other of the first and second plate surfaces, and the other of the first and second plate surfaces having a plurality of openings for receiving the wedge-shaped portions.

8. A system according to claim 7, wherein each wedge-shaped portion defines a stop surface and a sloping surface;

each opening for receiving the wedge shaped portions defines an edge for engaging the stop surface of one of the wedge-shaped portions upon the first part of the spin restricting mechanism being rotated in the first rotary direction;

each opening for receiving the wedge shaped portions defines at least one further edge for engaging and sliding over the sloping surface of one of the wedge-shaped portions upon the first part of the spin restricting mechanism being rotated in the second rotary direction.

9. A system according to claim 8, wherein the second plate of the spin restricting mechanism is biased toward the first plate of the spin restricting mechanism to engage the wedge-shaped portions on the second plate with the openings on the first plate.

10. A system according to claim 9, further comprising at least one spring for biasing the second plate of the spin restricting mechanism toward the first plate of the spin restricting mechanism.

11. A system according to claim 8, further comprising a wheel hub and coupling structure for coupling the wheel hub for rotation with the second plate of the spin restricting mechanism.

12. A system according to claim 11, wherein the coupling structure comprises a plurality of pins extending from the wheel hub through a corresponding plurality of pin openings in the second plate.

13. A system according to claim 8, wherein the second plate is moveable in the direction of the shared axis and wherein the second plate is biased toward the direction of the first plate.

14. A system according to claim 1, wherein the pressure part is operatively coupled to the motive transfer mechanism at a pivot point and moveable relative to the motive transfer mechanism in a tilting fashion between at least two states including a forward tilt state and a backward tilt state.

15. A system according to claim 14, wherein the pressure part is operatively coupled to the motive transfer mechanism at the same pivot point as the two arms.

16. A system according to claim 15, wherein the pressure part comprises a shoe.

17. A system according to claim 1, wherein the pressure part comprises a shoe.

18. A system according to claim 1, further comprising a pivotal rod having a longitudinal axis, the rod coupling the two arms at the pivot point, wherein the pivot point comprises a single pivot point at the longitudinal axis of the rod.

19. A method for assembling a system for converting a force applied in one direction to a rotational force comprising:

providing a pressure part for receiving a force directed in a first direction on a pressure part;

coupling two arms together at a pivot point for movement relative to each other in a scissors fashion between at least two states including an uncompressed state and a compressed state, coupling the pressure part to the two arms at a pivot point, for moving the two arms from the uncompressed state to the compressed state upon a suitable force in the first direction being received by the pressure part, while allowing the pressure part to tilt forward or back;

applying a bias force on at least one of the two arms, for biasing the two arms toward the uncompressed state, arranging a first part and a second part of a spin restricting mechanism to rotate together around a shared axis in a first rotary direction, but to rotate independently around the shared axis in a second rotary direction opposite to the first rotary direction; and linking at least one of the two arms to the first part of the spin restricting mechanism, to communicate movement of at least one of the arms from the uncompressed state to the compressed state into rotational motion of the first part of the spin restricting mechanism in the first rotary direction.

20. A method according to claim 19, further comprising communicating movement of the at least one of the arms from the compressed state to the uncompressed state into rotational motion of the first part of the spin restricting mechanism in a second rotary direction.

21. A system according to claim 1, wherein the two arms are moveable relative to the pressure part.

22. A method according to claim 19, wherein the two arms are coupled for movement relative to the pressure part.

23. A system according to claim 1, further comprising a wheel having a rolling surface arranged to roll on a supporting surface, where the wheel is operatively coupled to the second part of the spin restricting mechanism to rotate about the shared axis with rotation of the second part of the spin restricting mechanism, and where the rolling surface of the wheel is arranged to surround the shared axis.

* * * * *